US011278790B1

(12) United States Patent
Yang

(10) Patent No.: US 11,278,790 B1
(45) Date of Patent: Mar. 22, 2022

(54) MOVABLE FLIPPER DRAIN DEVICE OF PINBALL MACHINE

(71) Applicant: Chung-Po Yang, Kaohsiung (TW)

(72) Inventor: Chung-Po Yang, Kaohsiung (TW)

( * ) Notice: Subject to any disclaimer, the term of this patent is extended or adjusted under 35 U.S.C. 154(b) by 57 days.

(21) Appl. No.: 17/022,122

(22) Filed: Sep. 16, 2020

(30) Foreign Application Priority Data

Aug. 27, 2020 (TW) ..... 109129295

(51) Int. Cl.

| | |
|---|---|
| ***A63F 7/36*** | (2006.01) |
| ***A63F 7/02*** | (2006.01) |
| ***A63F 7/24*** | (2006.01) |
| *A63F 7/34* | (2006.01) |

(52) U.S. Cl.
CPC ..... *A63F 7/025* (2013.01); *A63F 7/2427* (2013.01); *A63F 7/2472* (2013.01); *A63F 2007/341* (2013.01)

(58) Field of Classification Search
CPC ..... A63B 7/025; A63B 7/027; A63B 7/2427; A63B 7/2481; A63B 7/22; A63B 7/2472; A63B 7/2409; A63B 2007/341
See application file for complete search history.

(56) References Cited

U.S. PATENT DOCUMENTS

| | | | | | |
|---|---|---|---|---|---|
| 2,910,296 | A | * | 10/1959 | Irwin | A63F 7/06 273/108.31 |
| 3,975,019 | A | * | 8/1976 | Barlow | A63F 7/027 273/121 A |
| 4,109,916 | A | * | 8/1978 | Breslow | A63F 7/027 273/121 A |
| 4,203,603 | A | * | 5/1980 | Konta | A63F 7/2409 273/121 R |
| 4,431,188 | A | * | 2/1984 | Hooker | A63F 7/027 273/121 A |
| 4,971,324 | A | * | 11/1990 | Grabel | A63F 7/027 273/119 A |

* cited by examiner

*Primary Examiner* — Raleigh W Chiu
(74) *Attorney, Agent, or Firm* — Leong C. Lei

(57) ABSTRACT

A flipper drain device of a pinball machine is provided, including a fixed rack and a drain and ball-striking assembly. The fixed rack is mounted in the pinball machine and includes guide rods. The drain and ball-striking assembly is mounted to the guide rods, such that the drain and ball-striking assembly is leftward/rightward movable but not rotatable on the guide rods. The drain and ball-striking assembly has a drain opening and a flipper provided at each of a left part and right part thereof. The drain and ball-striking assembly includes an operation table, which is provided with an operation member. The operation member controls the drain and ball-striking assembly to selectively move leftward/rightward. The operation table is provided with an operation button on each of a left part and a right part thereof for respectively controlling the flippers of the drain and ball-striking assembly to rotate.

1 Claim, 6 Drawing Sheets

MOVABLE FLIPPER DRAIN DEVICE OF PINBALL MACHINE

TECHNICAL FIELD OF THE INVENTION

The present invention relates to a movable flipper drain device of a pinball machine, and more particularly to a movable flipper drain device that includes a drain and flippers that are both movable leftward and rightward so as to enhance game interesting.

DESCRIPTION OF THE PRIOR ART

Pinball games are easy to operate, have high interesting of playing, and involve generally no gambling, and are not restricted to any specific ages for the player, and are thus widely prevailing in for example night markets, game centers, playing grounds, or shopping malls, where game machines are commonly deployed for game players to play the games. The pinball game has a table surface that constitutes a playing field on which scoring zones, bumpers, and lances are provided. A drain is provided on the table, and flippers are provided at the drain, so that a player may operate the flippers to strike and redirect a ball up back to the playing field for hitting the scoring zones and bumpers to gain point. Once the ball falls into the drain, the game ends.

For the known pinball games, the drain and the flippers are often made stationary and fixed, making it impossible to improve interesting and challenging of the game, so that when a player has played the game for a certain period of time, the interest of game goes down. Further, in such an arrangement, the ball may easily pass between the two flippers and goes directly into the drain, making the game ended. Thus, it is a challenge to the game manufacturers to upgrade the interesting, interactivity, and challenging of the pinball machine.

SUMMARY OF THE INVENTION

An objective of the present invention is to overcome the drawbacks discussed above by providing a movable flipper drain device that makes a drain and flippers movable leftward and rightward to thereby improve the interesting of the game.

To achieve the above objective, the present invention provides a flipper drain device, which comprises a fixed rack and a drain and ball-striking assembly, wherein the fixed rack is fixedly mounted in the pinball machine and comprises two fixed seats and a guide rod between the two fixed seats; and the drain and ball-striking assembly is mounted to and supported on the guide rod between the two fixed rack, such that the drain and ball-striking assembly is movable leftward or rightward on the guide rod and the drain and ball-striking assembly is not rotatable frontward and rearward, an upper surface of the drain and ball-striking assembly and a surface of a playfield of and the pinball machine being a same surface; the drain and ball-striking assembly is formed with a drain opening, a ball launch device being arranged below the drain opening, a curved guide plate being provided on the drain opening; the drain and ball-striking assembly comprises a flipper that is arranged on a left part and a right part of a portion of the upper surface thereof that is frontward of the drain opening, the flippers being controllable and drivable to rotate; the drain and ball-striking assembly comprises an operation table, which is provided with an operation member, the operation member being operable to control the drain and ball-striking assembly to selectively move leftward or rightward, the operation table comprises an operation button provided at each of a right left part and a right part of a top thereof, the two operation buttons being operable to control and drive the flippers of the drain and ball-striking assembly to rotate for striking a ball; and the drain and ball-striking assembly is provided with a cushion member on each of a left side and a right thereof.

As such, the drain and the flippers are made movable leftward and rightward, so as to provide a flipper drain device that could enhance interesting of the game.

DETAILED DESCRIPTION OF THE PREFERRED EMBODIMENT

Reference is now made to an embodiment of the present invention shown in FIGS. 1-6 for description of the technical solution that the present invention adopts to achieve the above objective and the structure thereof.

Figure 1:
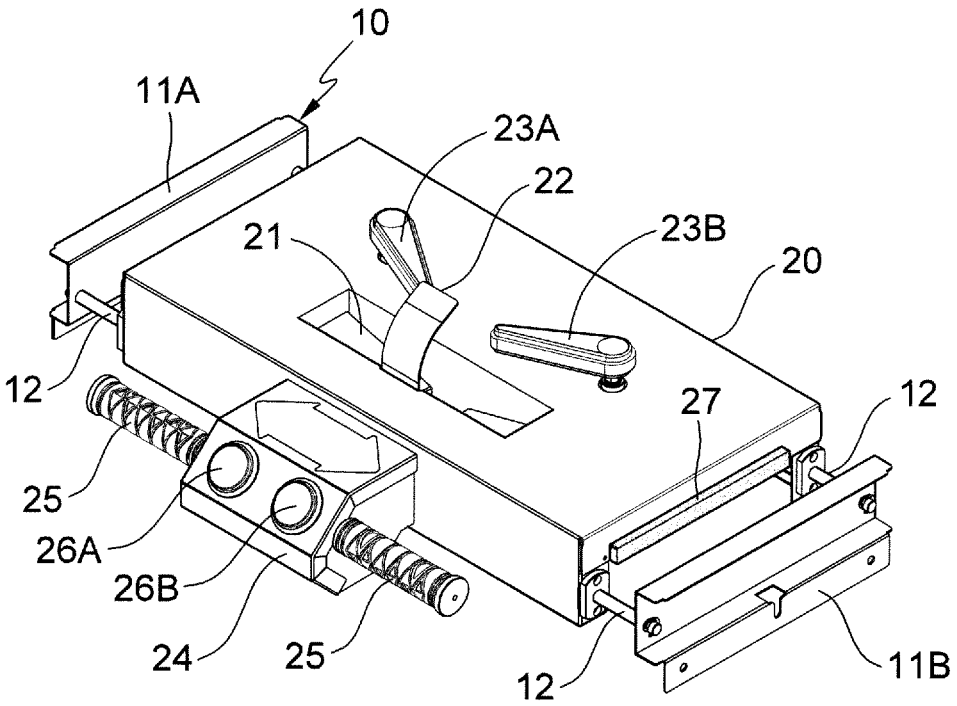
FIG. 1 is a perspective view of the present invention.

As shown in FIG. 1, the present invention provides, in an embodiment, a flipper drain device, which comprises a fixed rack 10 and a drain and ball-striking assembly 20.

The fixed rack 10 (see FIG. 2) is fixedly mounted inside a pinball machine 30 and comprises two fixed seats 11A, 11B and guide rods 12 arranged between the two fixed seats 11A, 11B.

The drain and ball-striking assembly 20 (see FIGS. 2, 3, and 4) is mounted to and supported on the guide rods 12 of the fixed rack 10, such that the drain and ball-striking assembly 20 is movable on the guide rods 12 in leftward and rightward directions and the drain and ball-striking assembly 20 is not rotatable either frontward or rearward. The drain and ball-striking assembly 20 has an upper surface that is generally flush with or in alignment with or the same as a surface of a playfield of the pinball machine 30. The drain and ball-striking assembly 20 is formed with a drain opening 21, and a ball launch device (not shown) is arranged below the drain opening 21. The drain opening 21 is provided with a curved guide plate 22. Further, the drain and ball-striking assembly 20 is provided, on the upper surface thereof, with a flipper 23A, 23B in each of a left part and a right part of a portion thereof that is located frontward of the drain opening 21, and the flippers 23A, 23B are drivable, in a controlled manner, to rotate. The drain and ball-striking assembly 20 is provided at one end thereof, with an operation table 24. The operation table 24 is provided thereon with operation members 25 (which are provided as two handles including a left one and a right one as shown in the drawings). The operation members 25 enable operation of controlling the drain and ball-striking assembly 20 to move leftward and/or rightward. The operation table 24 is provided an operation button 26A, 26B on each of a left part and a right part of a top thereof. The two operation buttons 26A, 26B are provided to, respectively, control and drive the flippers 23A, 23B provided on the upper surface of the drain and ball-striking assembly 20 to rotate and strike. Further, the drain and ball-striking assembly 20 is provided with a cushion member 27 on each of a left side and a right side thereof.

Figure 2:
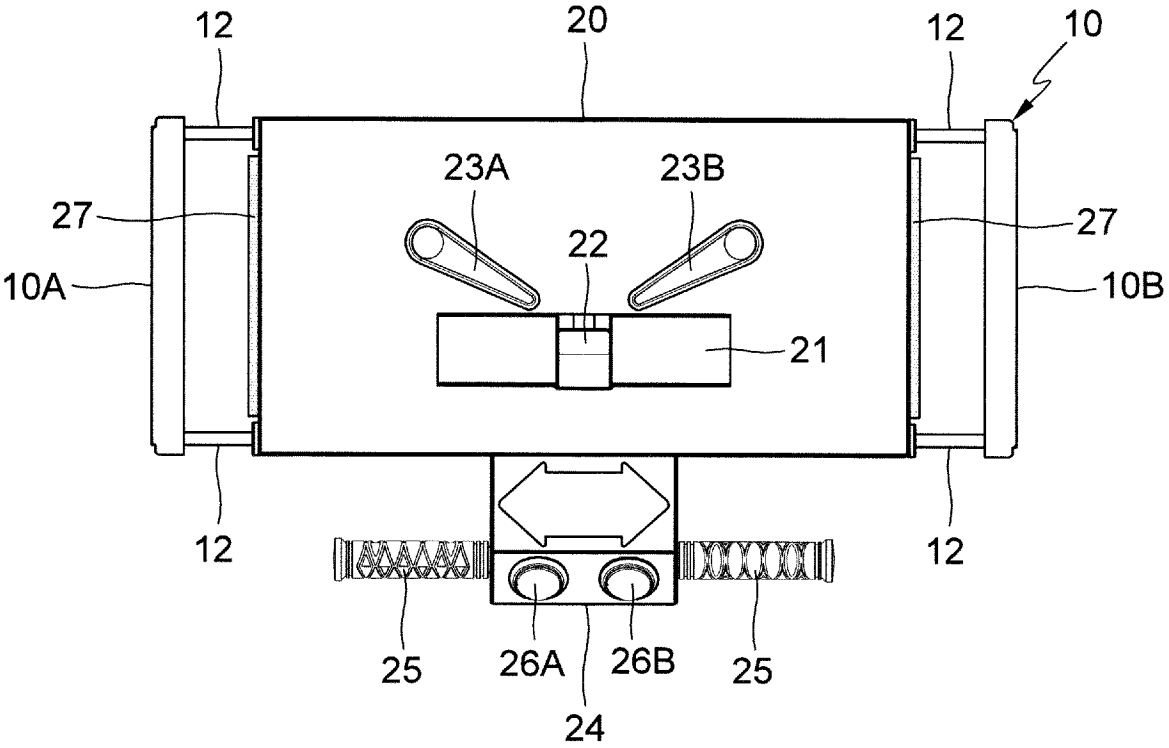
FIG. 2 is a top plan view of the present invention.
Figure 3:
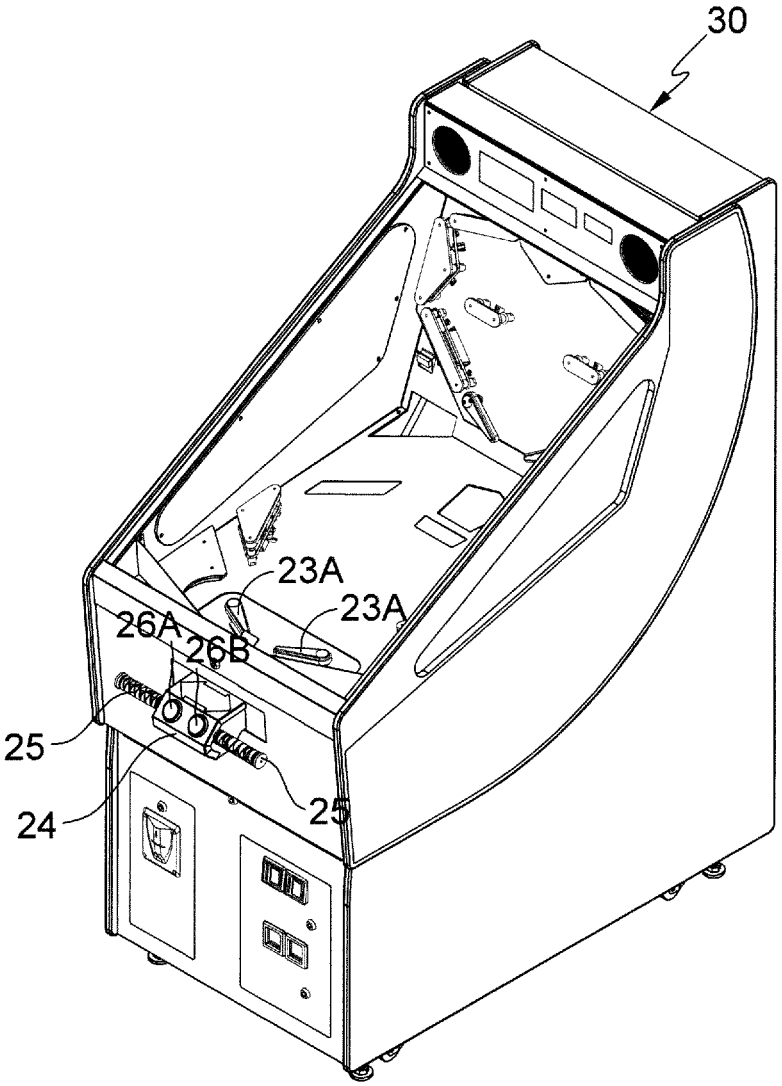
FIG. 3 is a perspective view showing the present invention mounted to a pinball machine.
Figure 4:
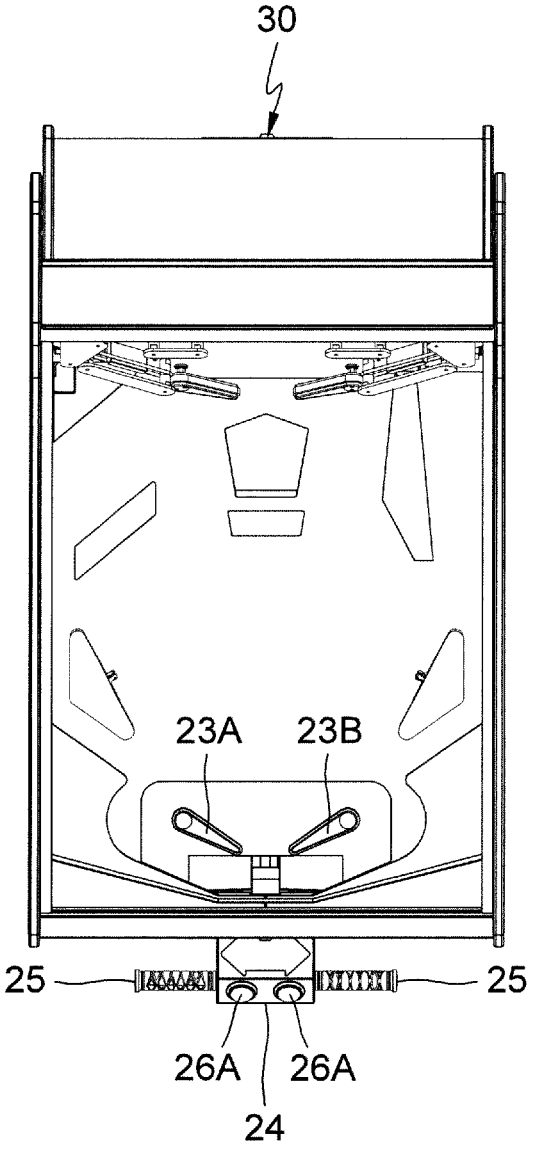
FIG. 4 is a top plan view showing the present invention mounted to the pinball machine.

Following the above description, a preferred embodiment is that the guide rods 12 of the fixed rack 10 are provided as two round bars (as shown in FIGS. 1 and 2) or square or rectangular bars, or guide rails, in order to support the drain and ball-striking assembly 20 thereon in a manner of being not rotatable thereon.

Figure 5:
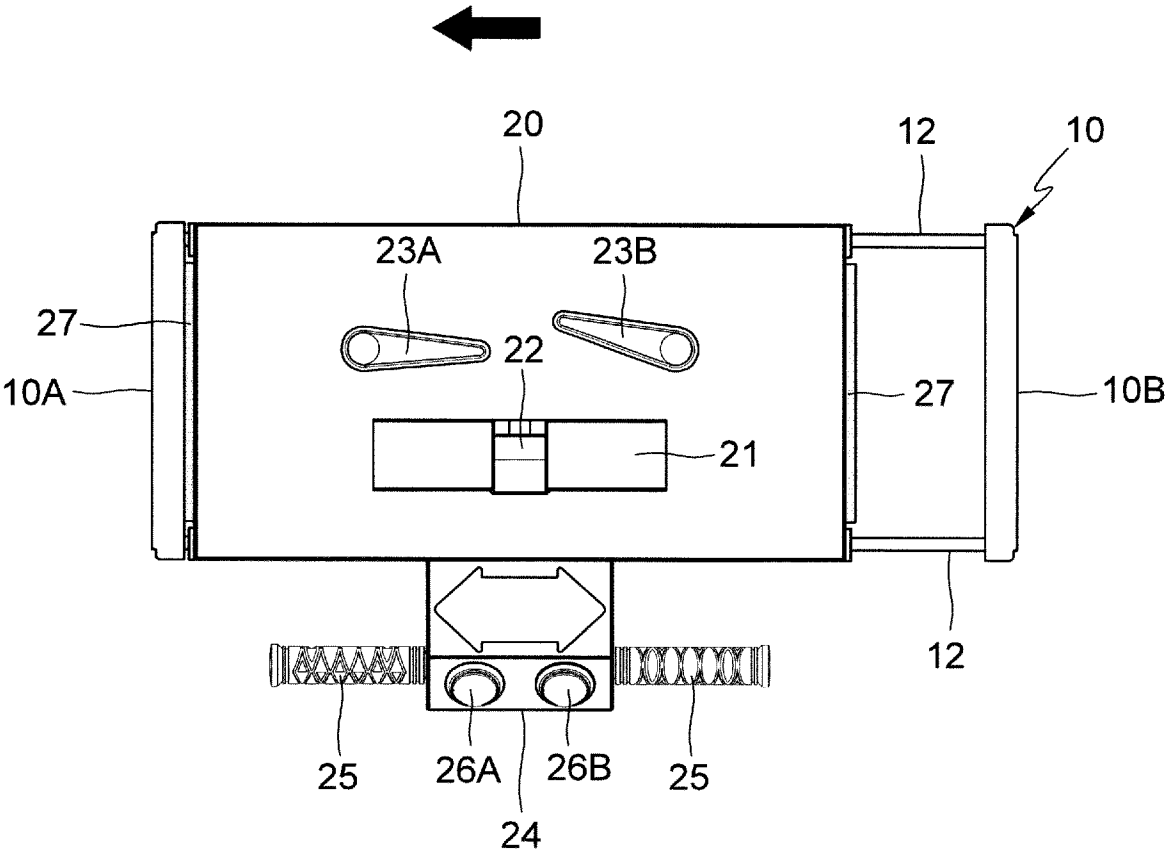
FIG. 5 is a top plan view of the present invention, demonstrating a movement of the drain and the flippers.
Figure 6:
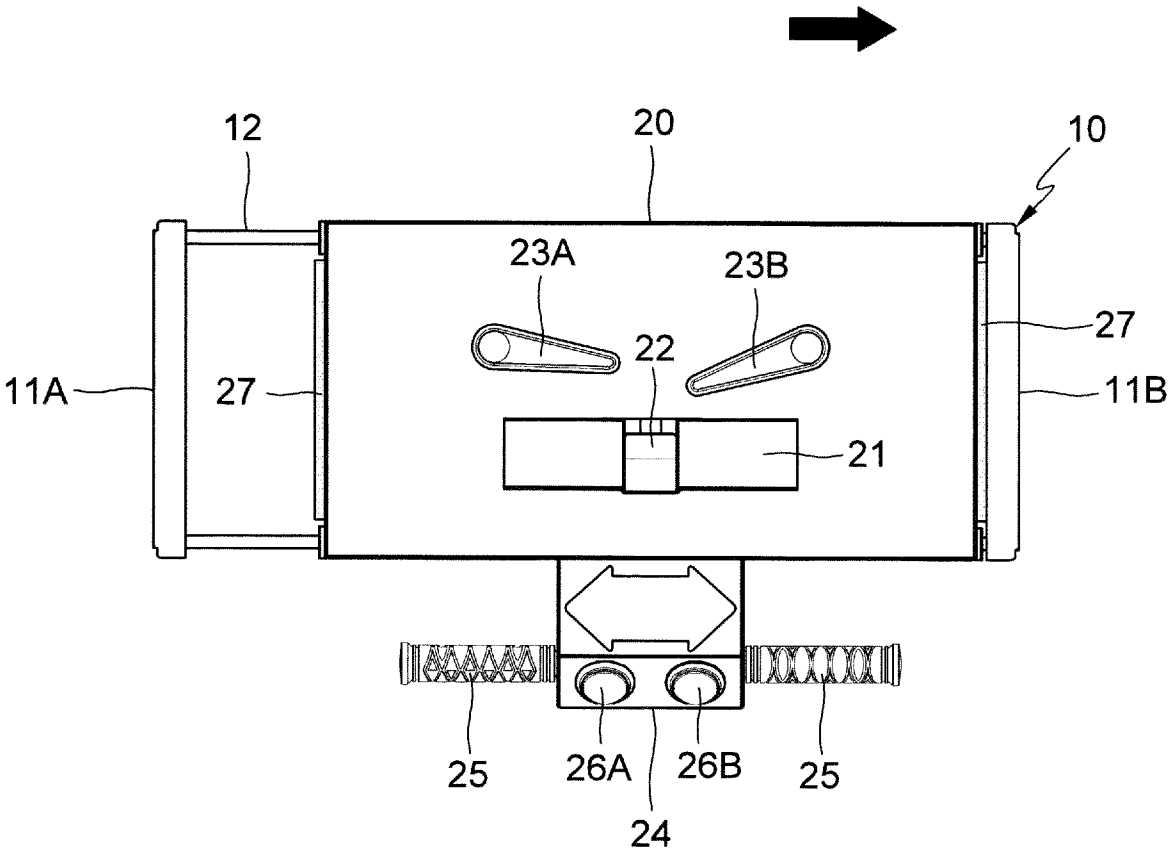
FIG. 6 is also a top plan view of the present invention, demonstrating a movement of the drain and the flippers.

Based on the above structure, since the drain and ball-striking assembly 20 is mounted to and supported on the guide rods 12, a player may operate the operation members 25 provided on the operation table 24 to drive the drain and ball-striking assembly 20 to selectively move leftward and/or rightward (as shown in FIGS. 5 and 6). The curved guide plate 22 provided on the drain opening 21 functions to guide a launched ball to the surface of the playfield of the game machine 30 to start a gamine. The player may then operate the left-side and right-side operation buttons 26A, 26B provided on the operation table 24 to respectively drive the left-side and right-side flippers 23A, 23B to rotate (as shown in FIGS. 5 and 6), so that the flippers 23A, 23B may strike and redirect the ball. When the drain and ball-striking assembly 20 are moved leftward (or rightward) to a left-side extreme position (or a right-side extreme position), due to the cushion members 27 provided at the left side and the right side of the drain and ball-striking assembly 20, direct impact of the drain and ball-striking assembly 20 with the fixed seats 11A, 11B can be avoided and vibration of collision can be reduced, and also damage of the drain and ball-striking assembly 20 caused thereby can be prevented.

Since a player is allowed to operate the drain and ball-striking assembly 20 of the present invention for leftward or rightward movement, the player may move the drain and ball-striking assembly 20 by following a movement path of the ball, and meanwhile making drain opening 21 and the flippers 23A, 23B moving so as to improve the chance of successfully striking the ball and the gain of score, and thus, the interesting, exciting, and man-machine interactivity of the game can be improved to enhance and train the speed of response of the player in making a movement and control.

Thus, it can be appreciated from the above description that the present invention is inventive and not obvious and provides a structural arrangement that has never been known. As such, it is believed this invention meet completely the requirement for a patent, and the application is so filed in order to pursue granting of patent.

However, it is noted that what described above is just one of the feasible embodiments of the present invention, and such an embodiment is provided as an example of illustration of the technical solution that the present invention may adopt to achieve the purpose of the present invention as described above, and the structure thereof, and is not intended to limit the scope of protection that the application pursues. All the equivalent variations and modifications that are made according to the above description and the appended claims are considered falling within the scope of protection for the present invention.

I claim:

1. A flipper drain device of a pinball machine, comprising a fixed rack and a drain and ball-striking assembly, wherein the fixed rack is fixedly mounted in the pinball machine and comprises two fixed seats and a guide rod between the two fixed seats; and the drain and ball-striking assembly is mounted to and supported on the guide rod between the two fixed rack, such that the drain and ball-striking assembly is movable leftward or rightward on the guide rod and the drain and ball-striking assembly is not rotatable frontward and rearward, an upper surface of the drain and ball-striking assembly and a surface a playfield of and the pinball machine being the same surface; the drain and ball-striking assembly is formed with a drain opening, a ball launch device being arranged below the drain opening, a curved guide plate being provided on the drain opening; the drain and ball-striking assembly comprises a flipper that is arranged on a left part and a right part of a portion of the upper surface thereof that is frontward of the drain opening, the flippers being controllable and drivable to rotate; the drain and ball-striking assembly comprises an operation table, which is provided with an operation member, the operation member being operable to control the drain and ball-striking assembly to selectively move leftward or rightward, the operation table comprises an operation button provided at each of a left part and a right part of a top thereof, the two operation buttons being operable to control and drive the flippers of the drain and ball-striking assembly to rotate for striking a ball; and the drain and ball-striking assembly is provided with a cushion member on each of a left side and a right side thereof.

* * * * *